US006059115A

United States Patent [19]

Ovadia

[11] Patent Number: 6,059,115

[45] Date of Patent: May 9, 2000

[54] RING TRAY WITH REPLACEABLE UPPER PADS

[76] Inventor: Joseph Ovadia, 109 Long Hill Rd., Little Falls, N.J. 07424

[21] Appl. No.: 09/231,038

[22] Filed: Jan. 14, 1999

[51] Int. Cl.[7] ..... B65D 1/34

[52] U.S. Cl. ..... 206/566; 206/6.1; 206/562; 206/565

[58] Field of Search ..... 206/6.1, 561, 562, 206/564, 565, 566

[56] References Cited

U.S. PATENT DOCUMENTS

| | | | |
|---|---|---|---|
| 1,456,613 | 5/1923 | Bartels | 206/6.1 |
| 4,282,975 | 8/1981 | Ovadia | 206/566 |
| 4,917,235 | 4/1990 | Feiler | 206/6.1 |
| 4,993,545 | 2/1991 | Feiler | 206/6.1 |
| 5,025,918 | 6/1991 | Bergeron | 206/6.1 |
| 5,505,294 | 4/1996 | Kilmartin, III et al. | 206/6.1 |
| 5,649,625 | 7/1997 | Ovadia | 206/6.1 |
| 5,826,711 | 10/1998 | Ovadia | 206/6.1 |

*Primary Examiner*—M. D. Patterson
*Assistant Examiner*—Nhan T. Lam
*Attorney, Agent, or Firm*—Richard M. Goldberg

[57] ABSTRACT

A ring tray includes a base having an upper surface, a lower surface, a plurality of elongated recesses in the upper surface, and a releasable holding arrangement on the upper surface in surrounding relation to the recesses and on the lower surface, the releasable holding arrangement being formed by layers of small hooks; a foam gripping member positioned in each recess for gripping a ring therein, the foam gripping member being folded so as to have a substantially M-shaped cross-section, formed by two inverted V-shaped portions connected together and between which the ring is gripped; and an upper pad having a fabric lower surface which is releasably held by the hooks in covering relation to the upper surface and the recesses, the upper pad including a central section engaged by the hooks on the upper surface, and two wrap-around sections connected at opposite sides of the central section, each wrapping around a side of the base and engaging the hooks on the lower surface, and the upper pad having a plurality of openings therein in alignment with the recesses and through which the ring can be inserted into the foam gripping member.

11 Claims, 7 Drawing Sheets

RING TRAY WITH REPLACEABLE UPPER PADS

BACKGROUND OF THE INVENTION

The present invention relates generally to display and storage devices, and more particularly, is directed to a ring tray for storing and displaying rings.

In one known ring tray, there is a rectangular frame with a central rectangular opening therein and an inwardly extending peripheral ledge. A bottom closing member is secured to the tray so as to close the underside of the tray, and is formed with a plurality of recesses therein in a generally honeycomb pattern. A top pad is secured to and closes the top of the tray. In this known ring tray, the top pad includes a thin lower sheet made of a rubber or similar material that is glued to the peripheral ledge of the frame, the lower sheet having a plurality of die cut slits formed therein which are aligned with each recess. In this manner, a ring can be pushed through a slit in the lower sheet so that it is held by the rubber material and seats in a recess. In order to provide an aesthetic appearance, a fabric upper pad having a plurality of openings is adhered to the upper surface of the lower sheet so that openings in the fabric upper pad are aligned with the slits in the lower sheet.

As an alternative to the above, another ring tray is known which is similar to the aforementioned ring tray. Specifically, rather than using a lower rubber sheet, a thin fabric sheet is used in place thereof. Since the thin fabric sheet provides substantially no holding force, as occurs with a rubber sheet, a foam pad is provided so as to seat in each recess and thereby hold the rings. The thin fabric sheet is adhered to the peripheral ledge and to the upper surface of the foam pad. After the thin fabric sheet is adhered to the foam pad, a plurality of slits are die cut therein. This results in the foam pad being likewise die cut and thereby aligned with the slits in the thin fabric sheet. In this manner, a ring can be pushed through a slit in the thin fabric sheet and held by the foam. A fabric upper pad having a plurality of openings is adhered to the upper surface of the thin fabric sheet, with the openings in alignment with the slits.

The above ring trays have certain disadvantages. In the first place, the fabric upper pad tends to get dirty and is difficult to clean. Also, in order to provide a different appearance of the upper pad, it is necessary to provide a completely new jewelry tray. Further, many stores do not like when the ring trays are empty and would prefer to cover up the empty slots.

Further, since the above ring trays are made from a plurality of different elements and layers, the cost and complexity of manufacturing the same is great.

OBJECTS AND SUMMARY OF THE INVENTION

Accordingly, it is an object of the present invention to provide a ring tray that overcomes the problems with the aforementioned prior art.

It is another object of the present invention to provide a ring tray having an easily replaceable upper pad.

It is still another object of the present invention to provide a ring tray in which upper pads having different looks and overall configurations can be used.

It is yet another object of the present invention to provide a ring tray that is easy and economical to use and manufacture.

In accordance with an aspect of the present invention, a jewelry tray includes a base having an upper surface, at least one recess in the upper surface, and a releasable holding arrangement; a securing member in each recess for holding a jewelry item in each recess; and an upper pad releasably secured on the base by the releasable holding arrangement in covering relation to the upper surface and the at least one recess, the upper pad having at least one opening therein in alignment with the at least one recess through which the jewelry item can be inserted into the securing member.

The releasable holding arrangement is provided on the upper surface in surrounding relation to the at least one recess, and on the lower surface. In one embodiment, the upper pad includes at least one wrap-around section that wraps around at least one side of the base and engages the releasable holding arrangement on the lower surface. Specifically, in this embodiment, the upper pad includes a central section engaged by the releasable holding arrangement on the upper surface, and two wrap-around sections connected at opposite sides of the central section, each wrapping around a side of the base and engaging the releasable holding arrangement on the lower surface. However, it is also possible for the wrap-around sections to be eliminated in which case the releasable holding arrangement on the upper surface alone would be used.

Preferably, the releasable holding arrangement includes a layer of hooks for releasably engaging a fabric lower surface of the upper pad.

In one embodiment, the securing member includes a foam gripping member positioned in each recess for gripping a jewelry item therein. The foam gripping member is folded so as to have a substantially M-shaped cross-section, formed by two inverted V-shaped portions connected together and between which the jewelry item is gripped.

In another embodiment, the foam gripping member is a solid foam material which is die cut along a center longitudinal line to provide two adjacent sections and between which the jewelry item is gripped.

Preferably, there are a plurality of parallel elongated recesses in the base. In one embodiment, the upper pad has a plurality of separated openings in alignment with the plurality of elongated recesses and through which jewelry items can be inserted into the securing members. In another embodiment, the upper pad has a plurality of elongated openings in alignment with the plurality of elongated recesses and through which jewelry items can be inserted into the securing members.

The above and other objects, features and advantages of the invention will become readily apparent from the following detailed description thereof which is to be read in connection with the accompanying drawings.

DETAILED DESCRIPTION OF THE PREFERRED EMBODIMENTS

Figure 1:
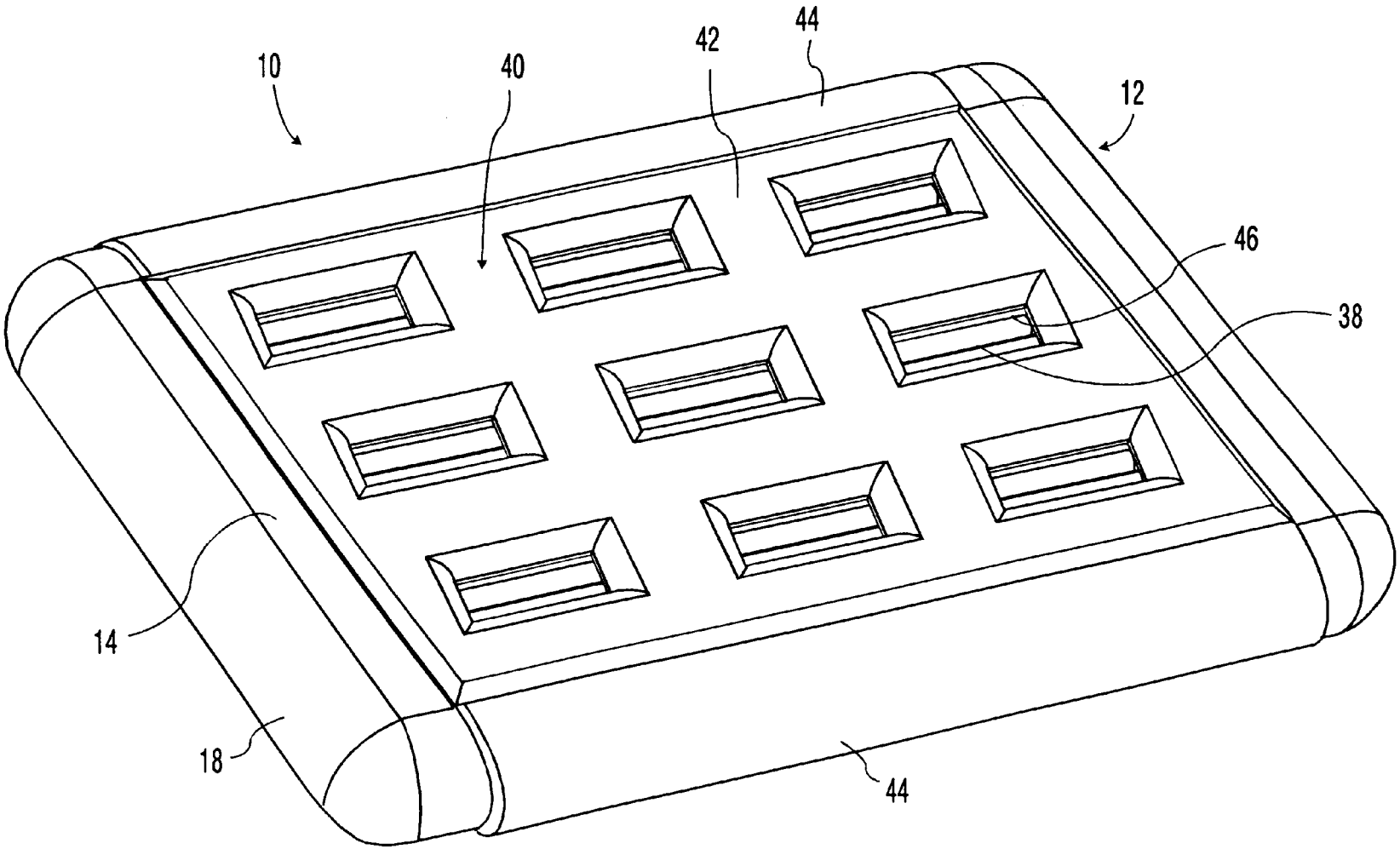
FIG. 1 is a perspective view of a ring tray according to the present invention.
Figure 2:
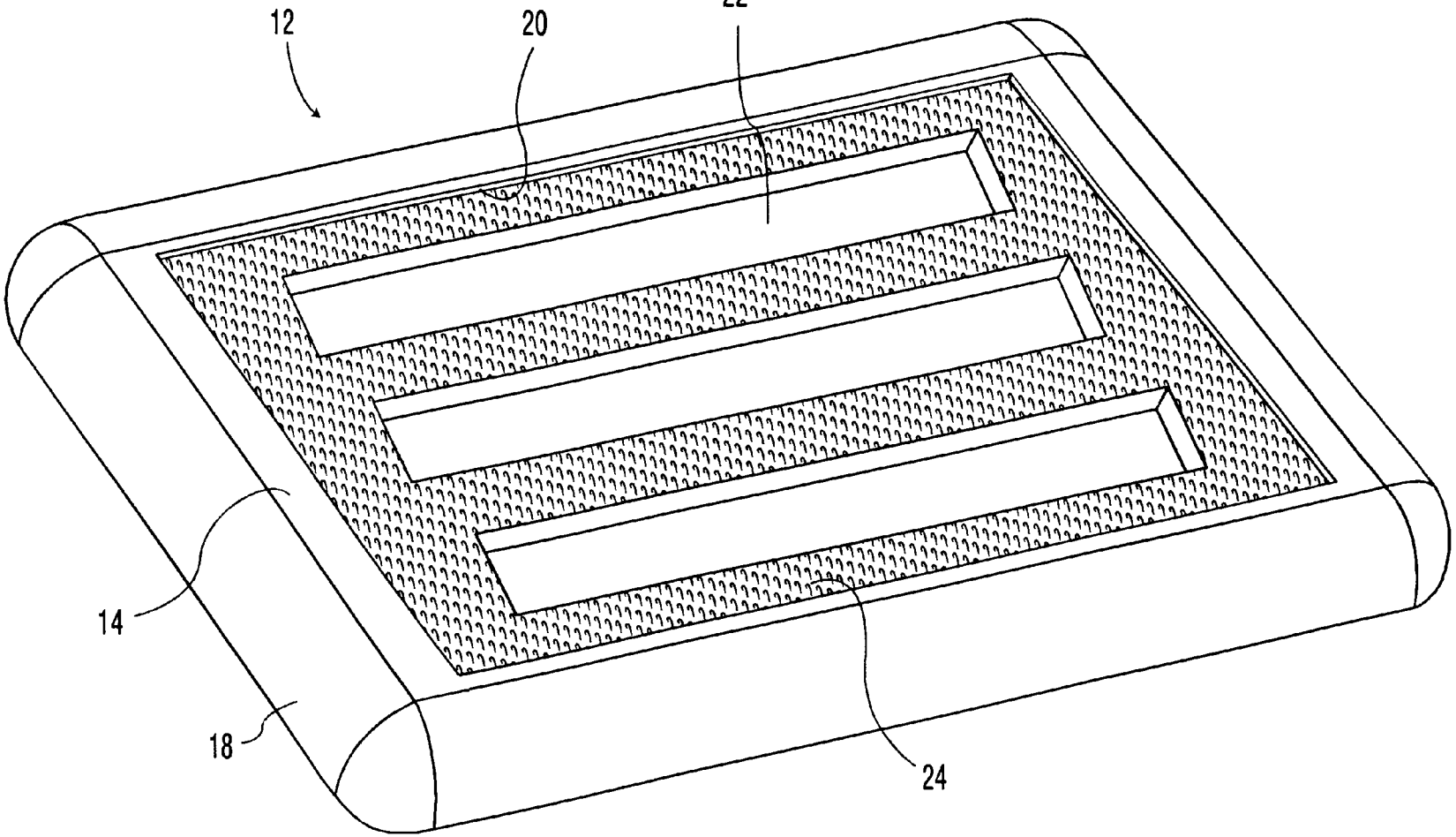
FIG. 2 is a perspective view of the wood base of the ring tray of FIG. 1, with the upper pad and foam gripping members removed.

Referring to the drawings in detail, a ring tray 10 according to one embodiment of the present invention includes a molded generally parallelepiped solid base 12 made from wood or any other suitable material. It will be appreciated, however, that base 12 can be formed in any shape, such as rectangular, circular, triangular, etc. Base 12 includes an upper planar surface 14, a lower planar surface 16 in parallel relation to upper planar surface 14, and an outer peripheral surface 18 between upper and lower planar surfaces 14 and 16.

A small height recessed area 20 is formed on upper planar surface 14. A plurality of elongated rectangular deep recesses 22 are formed in parallel spaced relation within recessed area 20 of upper planar surface 14. Although three such recesses 22 are shown, the present invention is not limited thereby.

Further, small hook elements 24 which are commonly sold as part of an arrangement under the trademark "VELCRO" are provided on the upper exposed surface of recessed area 20 in surrounding relation to deep recesses 22.

Figure 4:
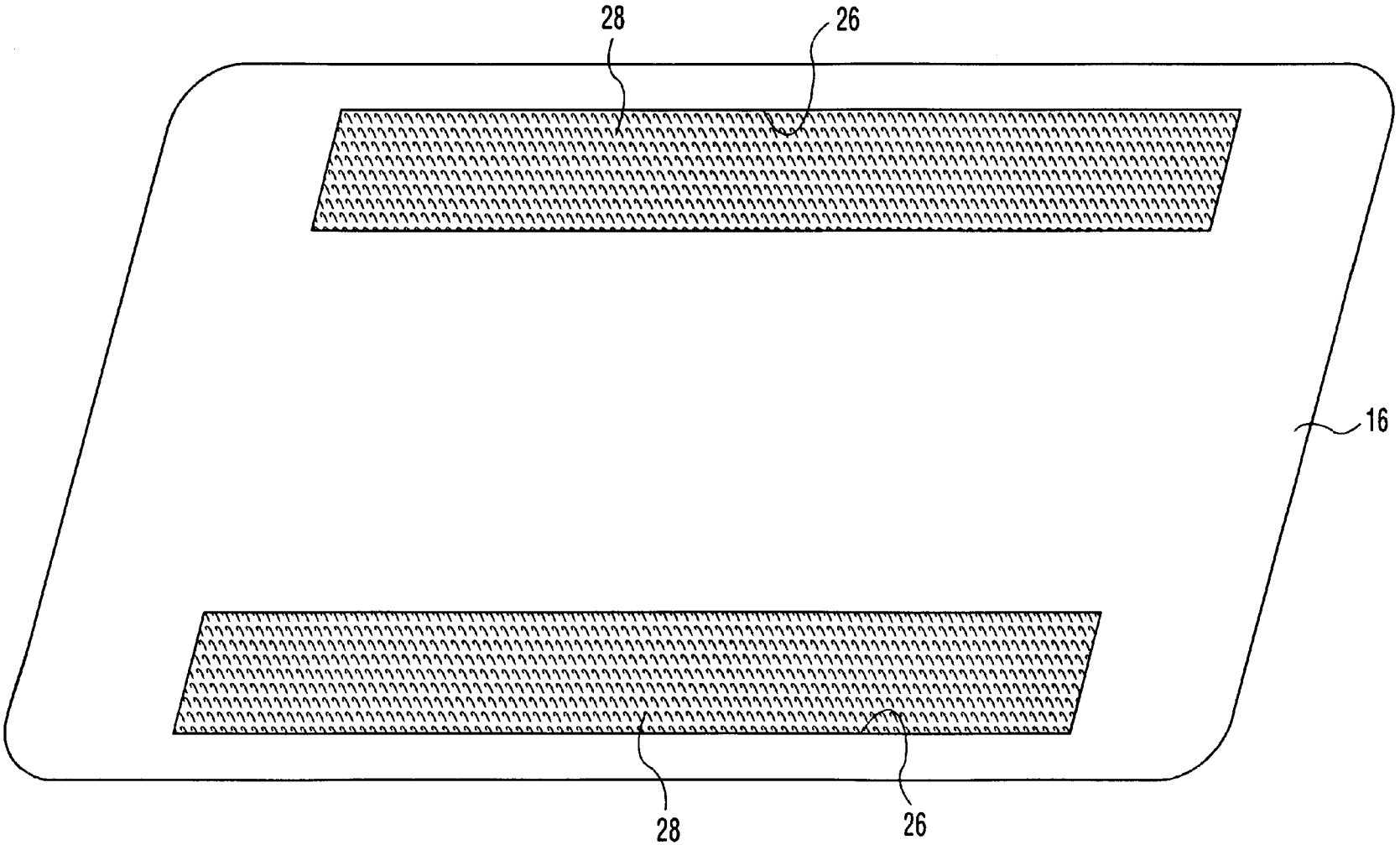
FIG. 4 is a bottom plan view of the wood base of FIG. 2.

As shown in FIG. 4, lower planar surface 16 is formed with two small height elongated recessed areas 26, and small hook elements 28 which are commonly sold as part of an arrangement under the trademark "VELCRO" are provided on the upper exposed surfaces of recessed areas 26.

Figure 3:
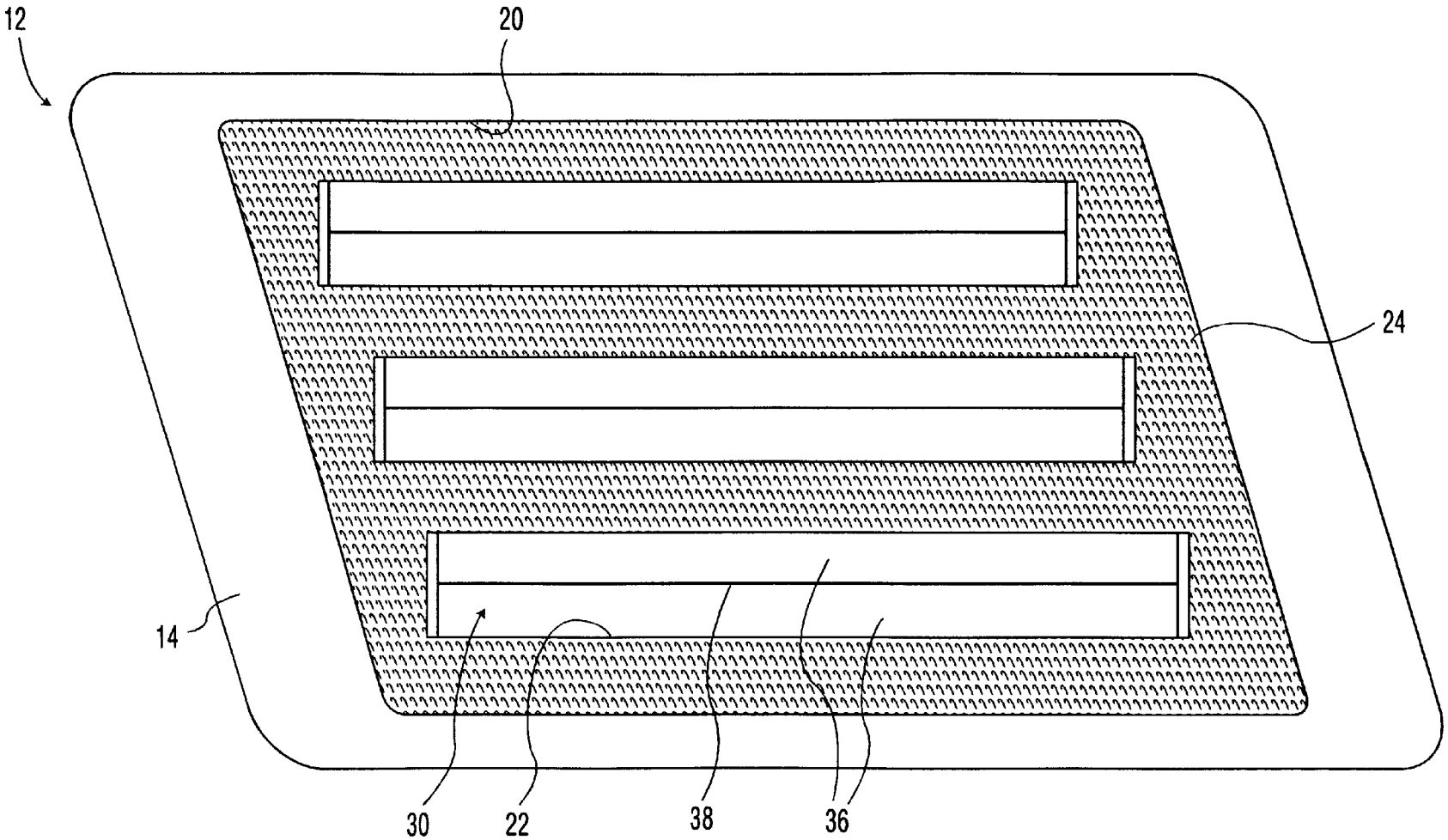
FIG. 3 is a top plan view of the wood base of FIG. 2.
Figure 5:
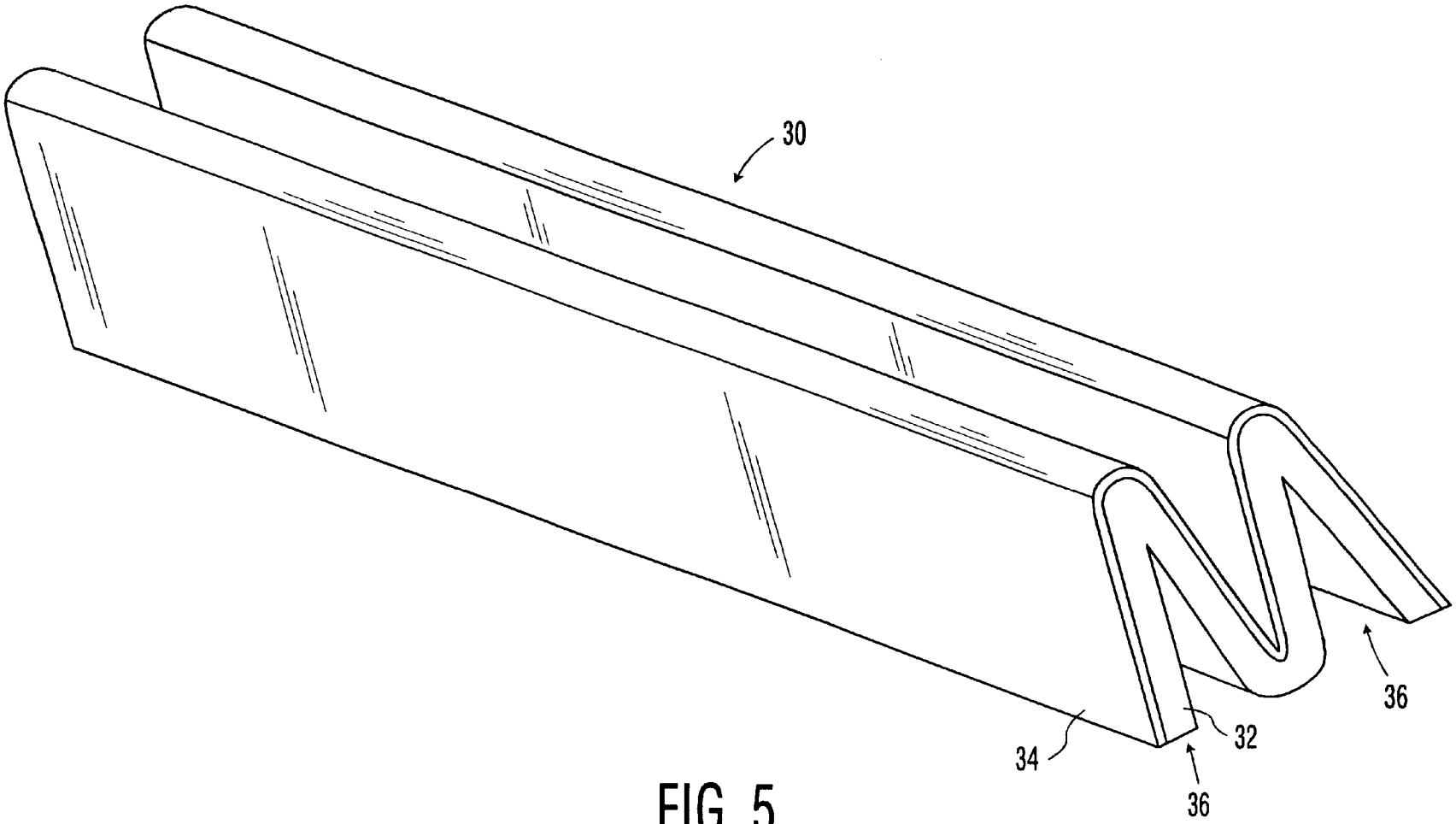
FIG. 5 is a perspective view of a foam gripping member.
Figure 6:
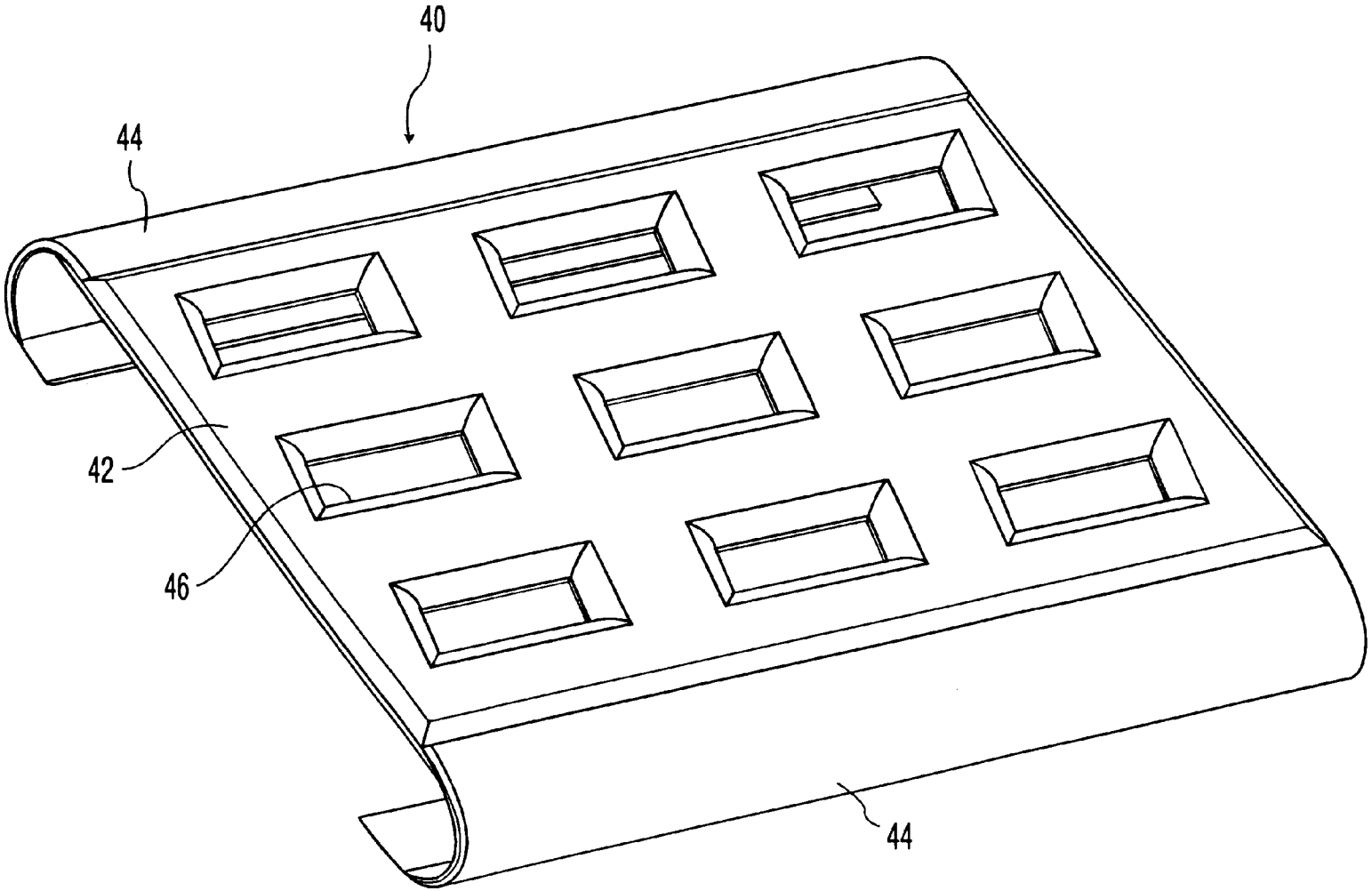
FIG. 6 is a perspective view of an upper pad according to one embodiment of the invention.

As shown in FIGS. 3 and 5, a foam gripping member 30 is provided in each deep recess 22. Each foam gripping member 30 is formed by a generally rectangular foam material 32 having a thin covering 34 of vinyl or other material thereon. Each foam gripping member 30 is folded into a substantially M-shape, that is, two connected inverted V-shaped portions 36 connected together, and then positioned in one deep recess 22. The center line 38 between the two inverted V-shaped portions 36 of foam gripping member 30 is adapted to receive a ring inserted therein so that the ring is held by and between inverted V-shaped portions 36. Alternatively, a solid piece of foam material can be placed in each recess 22 and die cut to form center line 38.

In order to provide an aesthetic appearance, an upper pad 40 of a foldable material, is provided over recessed area 20. Specifically, upper pad 40 is provided with a fabric or looped lower surface and a vinyl or other aesthetically pleasing upper surface. Upper pad 40 includes a central section 42 having a shape similar to that of recessed area 20 and of the same size or slightly larger, and two opposite wrap-around sections 44 of the same material and connected at opposite edges of central section 42. Further, central section 42 includes a plurality of rectangular openings 46 therein, arranged in parallel rows corresponding to recesses 22. Although nine openings 46 are shown, the present invention is not limited thereby. Thus, when upper pad 40 is arranged over recessed area 20, rectangular openings 46 are aligned with recesses 22. Further, wrap-around sections 44 wrap around peripheral surface 18 and terminate at lower planar surface 16. Specifically, the ends of wrap-around sections 44 terminate at recessed areas 26. Accordingly, the fabric lower surface of central section 42 is releasably held by the hook elements 24 in recessed area 20, and the fabric lower surface at the ends of wrap-around sections 44 are releasably held by the hook elements 28 in recessed areas 26.

In use, a ring is positioned through any opening 46 and pushed down so as to be releasably gripped between adjacent inverted V-shaped portions 36 of the respective foam gripping member 30 therein.

In accordance with the present invention, upper pad 40 can be replaced with a new upper pad 40 in the event of damage to the existing upper pad 40 or if there is too much dirt or deterioration of the upper pad 40. Alternatively, upper pad 40 can be replaced with a different upper pad 40 to impart a different appearance to ring tray 10, without replacing the entire ring tray 10.

Figure 7:
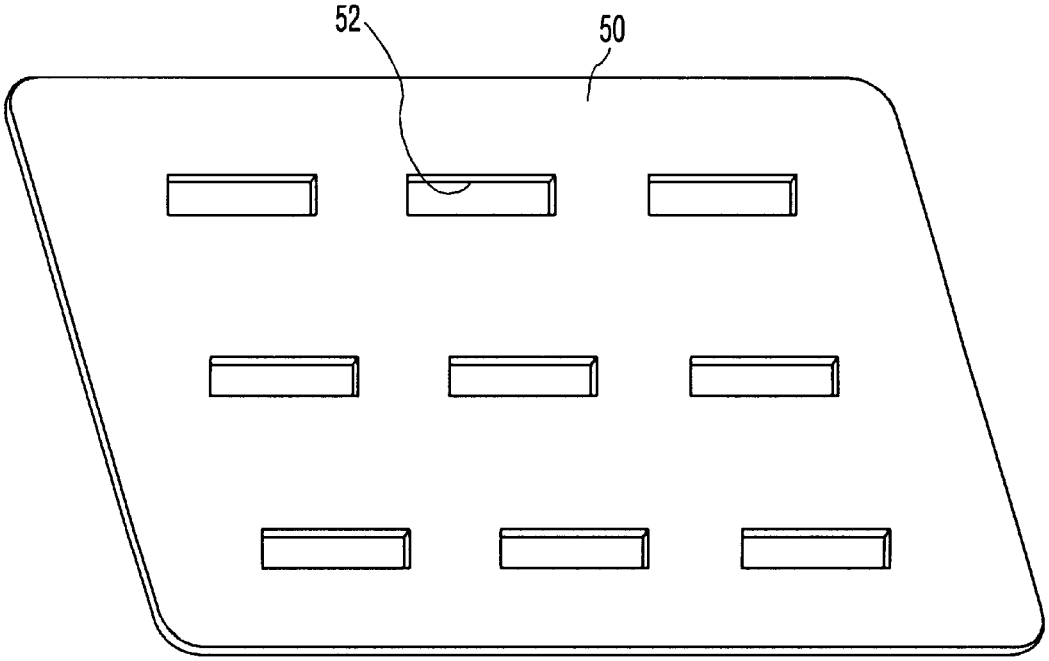
FIG. 7 is a perspective view of an upper pad according to another embodiment of the invention.

For example, a different upper pad 50, as shown in FIG. 7, can be used in place of upper pad 40. Upper pad 50 is provided over recessed area 20. Specifically, upper pad 50 is provided with a fabric or looped lower surface and a vinyl or other aesthetic upper surface. Upper pad 50 has a shape similar to that of recessed area 20 and of the same size or slightly larger. Unlike upper pad 40, there are no wrap-around sections. Upper pad 50 includes a plurality of rectangular openings 52 therein, arranged in parallel rows corresponding to recesses 22. Although nine openings 52 are shown, the present invention is not limited thereby. Thus, when upper pad 50 is arranged over recessed area 20, rectangular openings 52 are aligned with recesses 22. Accordingly, upper pad 50 is releasably held by hook elements 24 in recessed area 20.

Figure 8:
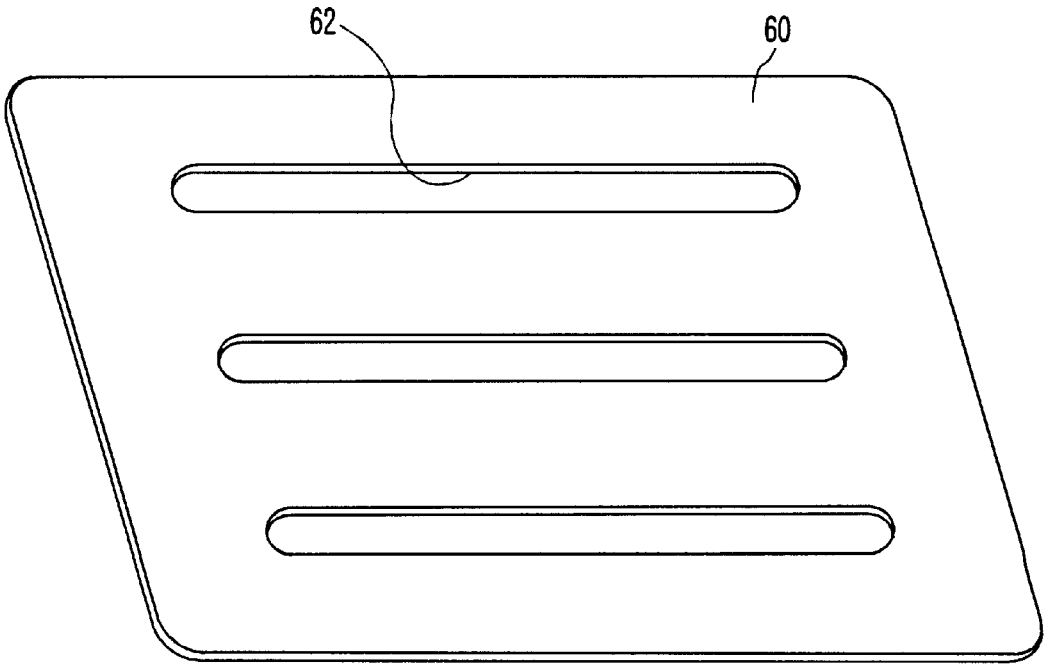
FIG. 8 is a perspective view of an upper pad according to still another embodiment of the invention.

As another example, a different upper pad 60, as shown in FIG. 8, can be used in place of upper pad 40. Upper pad 60 is provided over recessed area 20. Specifically, upper pad 60 is provided with a fabric or looped lower surface and a vinyl or other aesthetic upper surface. Upper pad 60 has a shape similar to that of recessed area 20 and of the same size or slightly larger. Unlike upper pad 40, there are no wrap-around sections. Upper pad 60 includes a plurality of parallel elongated openings 62 therein, corresponding to recesses 22. Although three elongated openings 62 are shown, the present invention is not limited thereby. Thus, when upper pad 60 is arranged over recessed area 20, elongated openings 62 are aligned with recesses 22. Accordingly, upper pad 60 is releasably held by the hook elements 24 in recessed area 20.

Thus, a solid wood ring tray 10 is provided having an easily replaceable upper pad 40, 50, 60 in which the upper pads provide different looks.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. A jewelry tray comprising:

a base including:

an upper surface, at least one recess in said upper surface, and a releasable holding arrangement provided on said upper surface in surrounding relation to said at least one recess;

a securing member in each said recess for holding a jewelry item in each said recess;

an upper pad releasably secured on said base by said releasable holding arrangement in covering relation to said upper surface and said at least one recess, said upper pad having at least one opening therein in alignment with said at least one recess through which the jewelry item can be inserted into said securing member; and said releasable holding arrangement including a layer of hooks for releasably engaging a lower surface of said upper pad having loops thereon for engagement by said hooks.

2. A jewelry tray according to claim 1, wherein said securing member includes a foam gripping member positioned in each said recess for gripping a jewelry item therein.

3. A jewelry tray according to claim 2, wherein said foam gripping member is folded so as to have a substantially M-shaped cross-section, formed by two inverted V-shaped portions connected together and between which the jewelry item is gripped.

4. A jewelry tray according to claim 2, wherein said foam gripping member is a solid foam material which is die cut along a center longitudinal line to provide two adjacent sections and between which the jewelry item is gripped.

5. A jewelry tray according to claim 1, wherein there are a plurality of parallel elongated said recesses in said base, and said upper pad has a plurality of separated openings in alignment with said plurality of elongated recesses and through which jewelry items can be inserted into said securing members.

6. A jewelry tray according to claim 1, wherein there are a plurality of parallel elongated said recesses in said base, and said upper pad has a plurality of elongated openings in alignment with said plurality of elongated recesses and through which jewelry items can be inserted into said securing members.

7. A jewelry tray comprising:

a base including:

a lower surface, an upper surface, at least one recess in said upper surface, and a releasable holding arrangement provided on said upper surface in surrounding relation to said at least one recess, and said releasable holding arrangement also provided on said lower surface;

a securing member in each said recess for holding a jewelry item in each said recess; and an upper pad releasably secured on said base by said releasable holding arrangement in covering relation to said upper surface and said at least one recess, said upper pad having at least one opening therein in alignment with said at least one recess through which the jewelry item can be inserted into said securing member, and said upper pad including at least one wrap-around section that wraps around at least one side of said base and engages said releasable holding arrangement on said lower surface.

8. A jewelry tray according to claim 7, wherein said releasable holding arrangement includes a layer of hooks for releasably engaging a lower surface of said upper pad having loops thereon for engagement by said hooks.

9. A jewelry tray according to claim 7, wherein said upper pad includes a central section engaged by the releasable holding arrangement on the upper surface, and two wrap-around sections connected at opposite sides of said central section, each wrapping around a side of said base and engaging said releasable holding arrangement on said lower surface.

10. A jewelry tray comprising:

a base including:

a lower surface, an upper surface, at least one recess in said upper surface, and a releasable holding arrangement provided on said lower surface;

a securing member in each said recess for holding a jewelry item in each said recess; and an upper pad releasably secured on said base by said releasable holding arrangement in covering relation to said upper surface and said at least one recess, said upper pad having at least one opening therein in alignment with said at least one recess through which the jewelry item can be inserted into said securing member, and said upper pad includes at least one wrap-around section that wraps around at least one side of said base and engages said releasable holding arrangement on said lower surface.

11. A jewelry tray according to claim 10, wherein said releasable holding arrangement includes a layer of hooks for releasably engaging a lower surface of said upper pad having loops thereon for engagement by said hooks.

* * * * *